United States Patent [19]

Greenfield, Jr.

[11] Patent Number: 4,507,096

[45] Date of Patent: Mar. 26, 1985

[54] GROUND EFFECT TOY

[76] Inventor: Richard M. Greenfield, Jr., 9750 SW. 158th St., Miami, Fla. 33257

[21] Appl. No.: 485,267

[22] Filed: Apr. 15, 1983

[51] Int. Cl.[3] ..... A63H 29/10; A63H 27/00

[52] U.S. Cl. ..... 446/176; 446/61

[58] Field of Search ..... 46/79, 1 J, 81, 74 R, 46/76 R; D21/89, 88, 87

[56] References Cited

U.S. PATENT DOCUMENTS

| | | | |
|---|---|---|---|
| D. 59,419 | 10/1921 | Haworth | D21/89 |
| D. 80,022 | 12/1929 | Ebbinghaus | D21/89 |
| D. 198,038 | 4/1964 | Huston, Jr. | D21/87 |
| D. 262,729 | 1/1982 | Barrett | D21/89 |
| D. 263,609 | 3/1982 | Barrett | D21/89 |
| 2,708,330 | 5/1955 | Ciampolini | 46/79 |
| 3,010,250 | 11/1961 | Huston, Jr. | 46/79 |
| 3,526,989 | 9/1970 | Wallace | 46/79 |
| 3,898,763 | 8/1975 | Rizzo | 46/79 |

*Primary Examiner*—Mickey Yu

*Attorney, Agent, or Firm*—Robert Van Der Wall

[57] ABSTRACT

There is provided a toy of a substantially elongated configuration having, in part, a generally rectangular member inclined at an acute angle with a surface over which the toy would be thrown. Continuously adjacent along the longitudinal edges and depending downwardly therefrom are two side skirts, preferably having an acute triangular shape. The acute angle of said triangle would be determined by, although not necessarily identical to, the acute angle made by the top member with the surface when the toy is at rest on that surface. The toy further having a pin to orient the toy as it travels, preferably a dorsal fin disposed near the trailing end of the toy, a handle disposed approximately two-thirds of the distance from the leading end to the trailing end of the toy, and a weight disposed near the leading end of the toy to minimize sailing of the leading end of the toy out of close proximity with the surface over which the toy is thrown. The toy is supported by ground effect when moving forward at sufficient velocity, being supported on a very low friction layer of air which is trapped in a cavity between the side skirts, and leaks from beneath the lower edges of the side skirts and trailing end of the toy.

7 Claims, 6 Drawing Figures

GROUND EFFECT TOY

FIELD OF THE INVENTION

This invention relates generally to the field of toys, and, more particularly, to a device which uses ground effect to support itself in close proximity to the ground or water solely by forward motion without hovering or any independently powered air pressurization means to achieve hovering.

BACKGROUND OF THE INVENTION

From the time they are born, children begin learning of the effects of friction and gravity upon motion. Even very young children appreciate that some effort is constantly needed to overcome friction if motion is to be maintained. When a toy with wheels is pushed, it soon comes to rest again.

Children also soon learn of the effects of gravity. An object that is not held quickly drops to the floor and objects that have wheels move much more easily along the floor than objects that do not have wheels. Object that hover or levitate are, therefore, very interesting to children because they defy the law of gravity.

Such fascination is not, of course, limited to children. Mankind remains concerned with efficient ways to overcome friction and gravity. Ever since the invention of primitive land vehicles, efforts have been made to reduce the friction associated with movement of vehicles, because friction wastes otherwise useful work. With watercraft, the emphasis is to reduce friction in the form of hydrodynamic drag, and with both land vehicles and watercraft at high speeds, there arises a need to reduce aerodynamic drag as well.

Thus, a toy that appears to simultaneously defy the laws of gravity and friction holds particular interest for children, and many adults as well. Moreover, such a toy can furnish an intriguing educational opportunity for everyone, and its study by engineers whould provide a model upon which to base future, substantially more efficient, ground and/or water transportation.

SUMMARY OF THE INVENTION

Bearing the foregoing in mind, the present invention embodies a revolutionary concept in reducing friction in movement that is closely in proximity to either the ground or water. It substantially eliminates contact with the ground or water when in a dynamic mode without the power consumption and paraphernalia associated with hovercraft. This is accomplished by the simple expedient of trapping ambient air beneath the invention and compressing it using an aerodynamic inclined plane or wedge in combination with the ground or water surface in close proximity therebeneath. The ambient air is trapped by being scooped in by the forward motion of the subject. When the object has reached sufficient forward speed, air pressure beneath the object pressing upward against the inclined plane is of such a force that it matches or balances the force of gravity upon the mass of the object, suspending the object in close proximity to the ground or water surface.

Since the preferred embodiment of the invention herewith described is a toy, forward motion is achieved by the toy being thrown in proximity to the ground by the user, but the concept of the toy is equally applicable to vehicular ground or water transporation for people and/or freight, and in such case forward motion would be achieved with conventional means such as, but not limited to, an airplane engine and propeller or even a small jet engine. When used as such a transportation means, the invention may be provided with wheels, pontoons, or other means to move it across the land or water surface until it reaches sufficient forward speed to balance its weight with air pressure and cease contact with the ground or water surface.

As a toy, the object is thrown by the user in close proximity to a substantially level surface such as the ground, a floor, or a relatively smooth water surface. It then travels in very close proximity to that surface although normally not in contact with it. If the surface is smooth, it will travel between 200 and 300 feet, skimming along the surface on ground effect assuming it does not hit anything. Children and adults alike are fascinated by the toy because it gives the appearance of being in contact with the ground, but travels fast, silently and a considerable distance without apparent means of support. If the surface over which the toy is thrown happens to have a sufficient downward gradient, e.g., a street going downhill, the toy will maintain speed or even accelerate until the downward gradient decreases to a point where the device can no longer maintain sufficient forward speed to hold it out of contact with the surface.

Accordingly, a principal object of the invention is to provide a toy that achieves a very low friction (and drag) movement over a generally smooth surface such as a street, sidewalk, floor, or relatively smooth water.

Another object of the invention is to provide an entertainment device that demonstrates the use of ground effect.

A related object of the invention is to provide an educational device to teach how friction and gravity may be effectively and efficiently overcome.

Another object of the invention is to furnish a model for the study of ground effect vehicles having practical application for the transportation of people and/or freight with significant energy conservation.

A further object of the invention is to provide an ultimately more economical and/or more efficient means of surface transportation.

Other objects and advantages will become apparent to those skilled in the art upon reading the following description and upon reference to the drawings.

In accordance with the invention there is provided a toy having a substantially elongated configuration and being comprised, in part, of a generally rectangular member inclined at an acute angle with a surface over which the toy would be thrown. Continuously adjacent along the longitudinal edges and depending downwardly therefrom are a plurality of side skirts, preferably having an acute triangular shape. The acute angle of said triangle would be determined by, although not necessarily identical to, the acute angle made by the top member with the surface over which the toy is thrown. The invention is further comprises of means to orient the toy as it travels, preferably a dorsal fin disposed near the trailing end of the invention, a handle disposed approximately two-thirds of the distance from the leading end to the trailing end of the invention, and a weight disposed near the leading end of the toy to minimize sailing of the leading ned of the invention out of close proximity with the surface over which the toy is thrown.

In accordance with another aspect of the invention, a large version thereof could be provided with an enclosure for people and/or freight in proximity to the top member, wheels or other means for movement at low speed, steering means, means for propulsion, and side thrusters or other means for assisting the invention in changing course, since in a dynamic mode it would not have contact with the surface. An air foil to supplement or furnish lift could be added. These additional features are not more fully described, illustrated or claimed since they are proposed for a later filed, but related and copending application.

DETAILED DESCRIPTION OF THE PREFERRED EMBODIMENT

Figure 1:
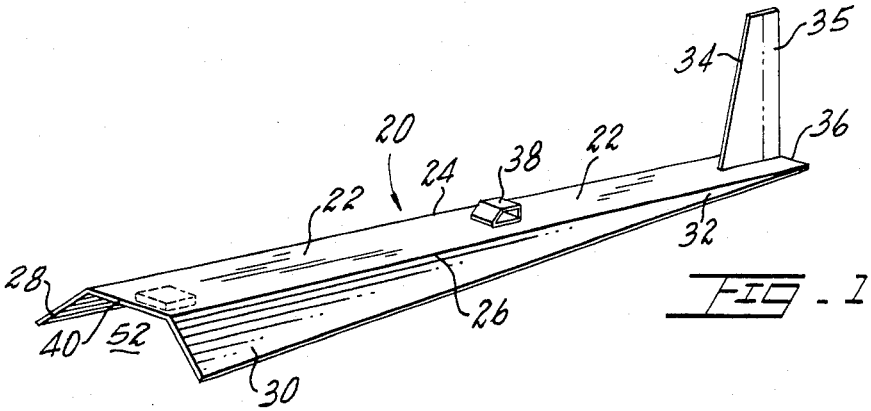
FIG. 1 is a perspective view of the invention illustrating its overall shape in a preferred form.
Figure 4:
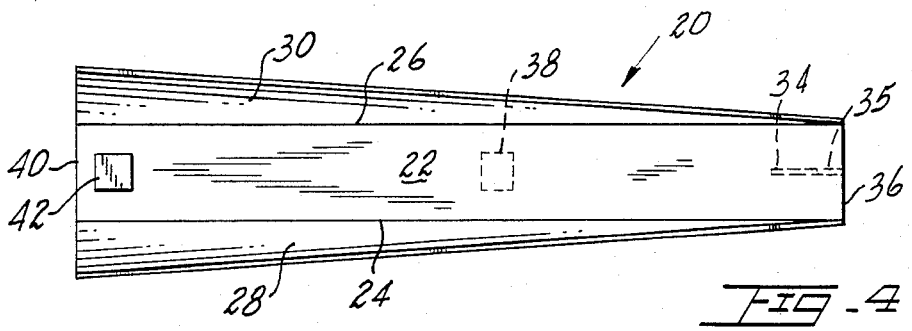
FIG. 4 is a bottom view of the preferred embodiment.

Referring to FIG. 1, the toy 20 has a substantially elongated configuration and is comprised principally of a generally rectangular preferably planar top member 22 inclined at a narrow, or acute, angle with a surface (not shown) over which the top would be thrown. Actually top member 22 will preferably have a planar lower surface as best shown in FIG. 4, but may be of any configuration, when traversing the toy from leading to trailing ends, that results in a decreasing mean distance between the top member 22 and the surface over which the toy travels. The result is thus of an inclined plane with respect to air in proximity to that surface, although the top member 22 may not be a plane, even on its lower surface. On is upper surface, departures from a planar configuration are even more acceptable. For example, an air foil or streamlined configuration may be utilized, possibly for the purpose of creating additional lift if an air foil were used. Adjacent along longitudinal edges 24 and 26 of top member 22, and depending downwardly therefrom are a plurality, preferably two, side skirts 28 and 30. Side skirts 28 and 30 will preferably have acute substantially equal angles 32 which will be determined by the acute angle that the top member 22 makes with the surface (not shown) over which the toy is thrown by the user. These acute angles 32 will generally not be equal to the acute angle that the top member makes with the surface because such angle depends on the shape of the side skirts which, in the preferred embodiment, do not depend downwardly from the top member at right angles thereto.

In the preferred embodiment, the side skirts 28 and 30 are disposed 35 degrees, and depend downwardly from, the plane of the top member 22. However, the 35 degree angle is not in any way critical to the invention and may be departed from significantly without altering the spirit and scope of the invention.

The invention is further comprised of means to orient the toy when in a dynamic mode, preferably a dorsal fin 34 disposed near the center of top member 22 and near to or adjacent the trailing end 36 thereof. Dorsal fin 34 may optionally be provided with a rudder 35 to cause the invention to turn in a predetermined, or even remote radio controlled, manner. The invention is further comprised of a handle 38 preferably disposed approximately two-thirds of the distance from the leading end 40 to the trailing end 36 of the invention. Again, however, the location of the handle is not critical and can be altered substantially or eliminated without departing from the spirit and scope of the invention.

Figure 2:
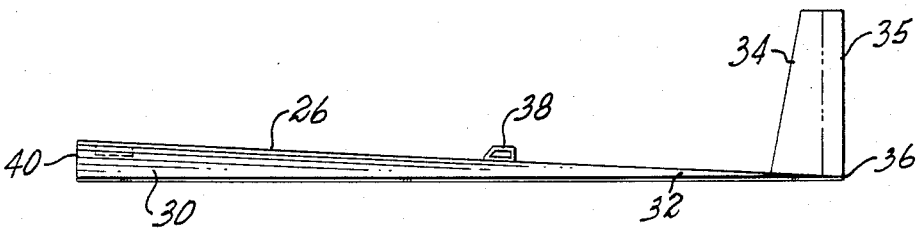
FIG. 2 is a side view of the same form of the invention as in FIG. 1.

Turning now to FIG. 2, only longitudinal edge 26 of top member 22 can be seen. Handle 38, dorsal fin 34 and side skirt 30 are readily seen.

Figure 3:
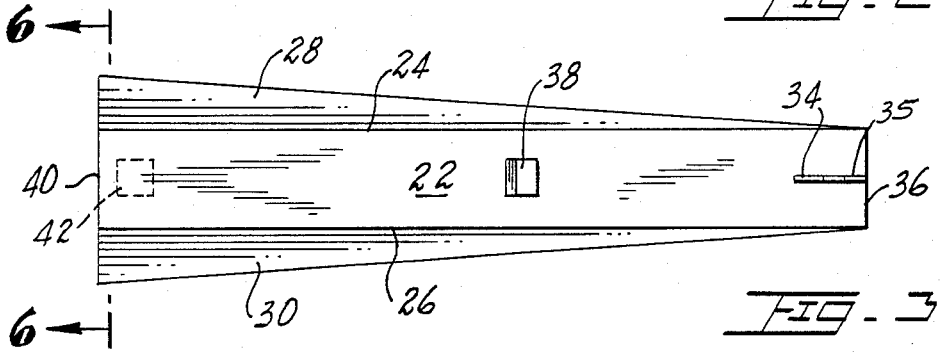
FIG. 3 is a top view of the preferred embodiment.

In FIG. 3, side skirts 28 and 30 in continuous adjacency along longitudinal edges 24 and 26 of top member 22 can be seen. The substantially central position of dorsal fin 34 on top member 22 and near its trailing end 36 thereof is also readily seen. So, too, is the substantially central position of handle 38 on top member 22.

FIG. 4 is a bottom view of the toy 20 showing the preferably planar undersurfaces of top member 22, longitudinal edges 24 and 26, and side skirts 28 and 30 continuously adjacent thereto. Near leading end 40 on the lower surface of top member 22 is weight 42, which is so disposed to minimize sailing of the leading end 40 of the invention. Absent weight 42, the leading end of the invention has a tendency to rise up out of close proximity with the surface over which the toy is thrown, much in the manner of a paper airplane. Close proximity of the invention to the surface over which it is thrown is important to maintain stability of the invention in use.

Figure 5:
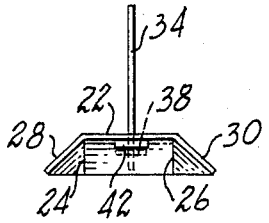
FIG. 5 is a front view of the preferred embodiment.

Turning to FIG. 5, the central locations of dorsal fin 36 and handle 38 on top member 22 and the symmetric configuration of side skirts 28 and 30 are emphasized. The underside of longitudinal edges 24 and 26 and the forward edge of weight 42 are also visible.

Figure 6:
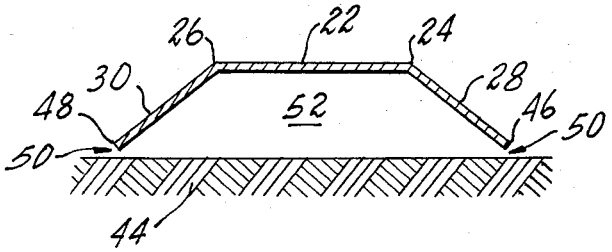
FIG. 6 is an enlarged section view of the preferred embodiment taken through the line 6—6 of FIG. 3.

Finally turning to FIG. 6, a cross section of leading end 40 of the invention is shown. Top member 22 is adjacent to side sqirts 28 and 30 at longitudinal edges 24 and 26. The surface 44 over which the toy is thrown is shown in close proximity to the lower edges 46 and 48 of side skirts 28 and 30. However, therebetween there is an air gap 50. As the invention moves forward after being thrown by the user, air is trapped in the cavity 52 which cavity is tapered down to naught at trailing end 36 as shown in FIG. 2. The air trapped by the forward motion of the toy 20 in cavity 52 is slightly compressed by the inclined plane character of top member 22 and can only escape through air gap 50 between lower edges 46 and 48 of side skirts 28 and 30. The effect is a substantially even leakage around the edges 46 and 48, said leakage preventing contact of edges 46 and 48 with the surface 44 over which the object is thrown. So long as the toy maintains sufficient forward motion to trap in cavity 52 sufficient air, the invention will be supported both by the slightly compressed air in cavity 52 and by the leakage of air through gap 50. It will thus proceed forward on a very low friction layer of air and by the aerodynamic drag involved in compressing the gas in cavity 52 and in travelling forward through the air. Such friction and drag eventually slows the top down to a point where edges 46 and/or 48 come in contact with surface 44, thus substantially increasing drag and stopping the toy. An irregular surface 44 accomplishes the same result or, of course, contact with any other object resting on surface 44 will do likewise.

Having described the presently preferred embodiments of the invention, it should be understood that various changes in construction and arrangement will be apparent to those skilled in the art and are fully contemplated there without departing from the true spirit of the invention. Accordingly, there are covered all alternatives, modifications and equivalents as may be included within the spirit and scope of the invention as defined herein by the appended claims.

What is claimed is:

1. A ground effect toy for low frictional movement in proximity to a substantially smooth surface comprising:

a rectangular top member having leading, trailing, and side elongated edges, and having a substantially planar underside that forms an acute angle with the surface at the trailing edge when the toy is at rest on the surface;

two acute triangular side skirts depending downwardly from the side elongated edges of said top member, said side skirts having elongated edges which are continuously adjacent the side elongated edges of the top member and having leading edges in transverse proximity to the leading edge of the top member;

said triangular side skirts having their leading edges as the base of the triangles and said side skirts tapering rearwardly to form peaks of the triangles in transverse proximity to the trailing edge of the top member;

said rearwardly tapering side skirts and said planar rectangular top member forming, when the toy is in movement across a smooth surface, an air compressing and trapping cavity between said toy and said smooth surface, whereby said trapped air will cause a supporting lift on said toy as long as forward movement of said toy is maintained;

means to maintain a leading edge of the toy in proximity to the surface during movement thereof; and means attached to the toy to orient a leading edge thereof forwardly during movement.

2. The ground effect toy of claim 1 where the means to orient comprises a dorsal fin attached to the toy proximal the trailing end thereof.

3. The ground effect toy of claim 1 in which the two side skirts depend downwardly at angles of 35 degrees from the top member.

4. The ground effect toy of claim 1 which further comprises a handle attached to the top member.

5. The ground effect toy of claim 12 wherein the handle is disposed two-thirds of the distance from a leading end to a trailing end of the toy.

6. The ground effect toy of claim 1 which further comprises means to turn the toy.

7. The toy of claim 14 wherein the means to turn comprises a rudder.

* * * * *